US005647181A

United States Patent [19]

Hunts

[11] Patent Number: 5,647,181

[45] Date of Patent: Jul. 15, 1997

[54] CONSTRUCTION SYSTEM AND METHOD FOR CONNECTING RIGID SHEET-LIKE PANELS TOGETHER INTO DOLL HOUSES, PLAY HOUSES, UTILITY SHEDS AND OTHER STRUCTURES

[76] Inventor: Larry David Hunts, 1111 Netherlands Rd., Trail, Oreg. 97541

[21] Appl. No.: 321,190

[22] Filed: Oct. 11, 1994

[51] Int. Cl.[6] ..... E04B 1/38

[52] U.S. Cl. ..... 52/282.1; 52/282.2; 312/265.5; 312/111; 312/140; 446/120

[58] Field of Search ..... 52/282.2, 282.1; 312/111, 265.5, 265.6, 140; 446/476, 120, 121

[56] References Cited

U.S. PATENT DOCUMENTS

| | | | |
|---|---|---|---|
| 1,818,404 | 8/1931 | Kaufman . | |
| 3,566,561 | 3/1971 | Tozer . | |
| 3,729,881 | 5/1973 | Disko . | |
| 3,820,299 | 6/1974 | Verholt | 52/282.2 |
| 4,279,455 | 7/1981 | Sunto | 312/140 X |
| 4,306,371 | 12/1981 | Walmer et al. . | |
| 4,557,091 | 12/1985 | Aver | 52/282.2 X |
| 5,061,219 | 10/1991 | Glickman | 446/126 |
| 5,238,438 | 8/1993 | Glickman | 446/126 |
| 5,350,331 | 9/1994 | Glickman | 446/120 X |
| 5,368,514 | 11/1994 | Glickman et al. | 446/120 X |
| 5,470,139 | 11/1995 | Hsiao | 312/111 X |

FOREIGN PATENT DOCUMENTS

| | | | |
|---|---|---|---|
| 1037343 | 8/1958 | Germany . | |
| 2643270 | 3/1978 | Germany | 52/282.2 |
| 1167982 | 2/1969 | United Kingdom | 312/111 |

*Primary Examiner*—Carl D. Friedman
*Assistant Examiner*—Aimee E. McTigue
*Attorney, Agent, or Firm*—Olson & Olson

[57] ABSTRACT

The invention provides the peripheral edge portions of rigid sheet-like panels with locking edges arranged for mating, snap-fit locking engagement by panel connector members, whereby a plurality of panels may be connected together to form building structures such as doll houses, children's play houses, utility sheds and the like.

7 Claims, 15 Drawing Sheets

CONSTRUCTION SYSTEM AND METHOD FOR CONNECTING RIGID SHEET-LIKE PANELS TOGETHER INTO DOLL HOUSES, PLAY HOUSES, UTILITY SHEDS AND OTHER STRUCTURES

BACKGROUND OF THE INVENTION

This invention relates to doll houses, play houses, sheds and the like, and more particularly to those that are provided in kit form for simplified assembly.

Although some kits for the "do it yourself" assembly of doll houses have been provided heretofore, it is far more common in the marketplace to find only pre-assembled, permanently constructed doll houses being available, accompanied by the attendant disadvantages of storage problems and extremely high cost that necessarily includes the manufacturer's assembly labor as well. Illustrative of the doll house kits that are known is U.S. Pat. No. 4,306,371 (22 Dec. 1981—Walmer et al), which simply provides a plurality of pre-formed specialty floor, wall and roof panels (FIG. 3) which are assembled according to a set of instructions to form a specific doll house construction having a single, pre-determined floor plan.

Illustrative of kit assemblies that provide for the creative connection of panels together to form various building structures are U.S. Pat. No. 3,729,881 (1 May 1973—Disko); U.S. Pat. No. 3,566,561 (2 Mar. 1971—Tozer); and German Patent No. 1,037,343 (1958). The German patent is the most pertinent of the above to the invention.

SUMMARY OF THE INVENTION

In its basic concept this invention provides specially configured panel edges preferably about all peripheral edges of a plurality of rigid, sheet-like panel and a variety of correspondingly configured panel connector members arranged to engage each panel edge in a positively locking, yet releasable, snap-fit connection, to provide a panel connection system in which panels can be secured together in locking engagement with each other into any desired arrangement of interconnected walls, floors and roofs to form extremely rigid building structures with a virtually limitless variety of rooms, levels and floor plan.

It is by virtue of the foregoing basic concept that the principal objective of this invention is achieved; namely, to overcome the disadvantages and limitations of the prior art.

Another object of this invention is the provision of a panel connecting system of the class described which can be provided in kit form for use by children and one which will also spark the child's imagination and creativity.

Another object of this invention is the provision of a panel connection system of the class described in which doll houses and the like can be assembled and disassembled easily, and may also be "remodeled" and changed in whole or in part without requiring complete disassembly of the existing structure.

Yet another object of this invention is the provision of a panel connecting system of the class described in which, when assembled, the panels are utilized for the structural integrity and strength of the resulting building, and forms a unitary, virtually "one-piece" assembled construction that is very strong.

A further object of this invention is the provision of a panel connecting system of the class described which may utilize specially configured panels, or alternatively, may provide specially configured locking edges for standard panels such as plywood sheets and the like for larger scale constructions.

A still further object of this invention is the provision of a panel connecting system of the class described which is of simplified construction for economical manufacture.

The foregoing and other objects and advantages of this invention will appear from the following detailed description, taken in connection with the accompanying drawings of the preferred embodiments of the invention.

DESCRIPTION OF THE PREFERRED EMBODIMENTS

Figure 1:
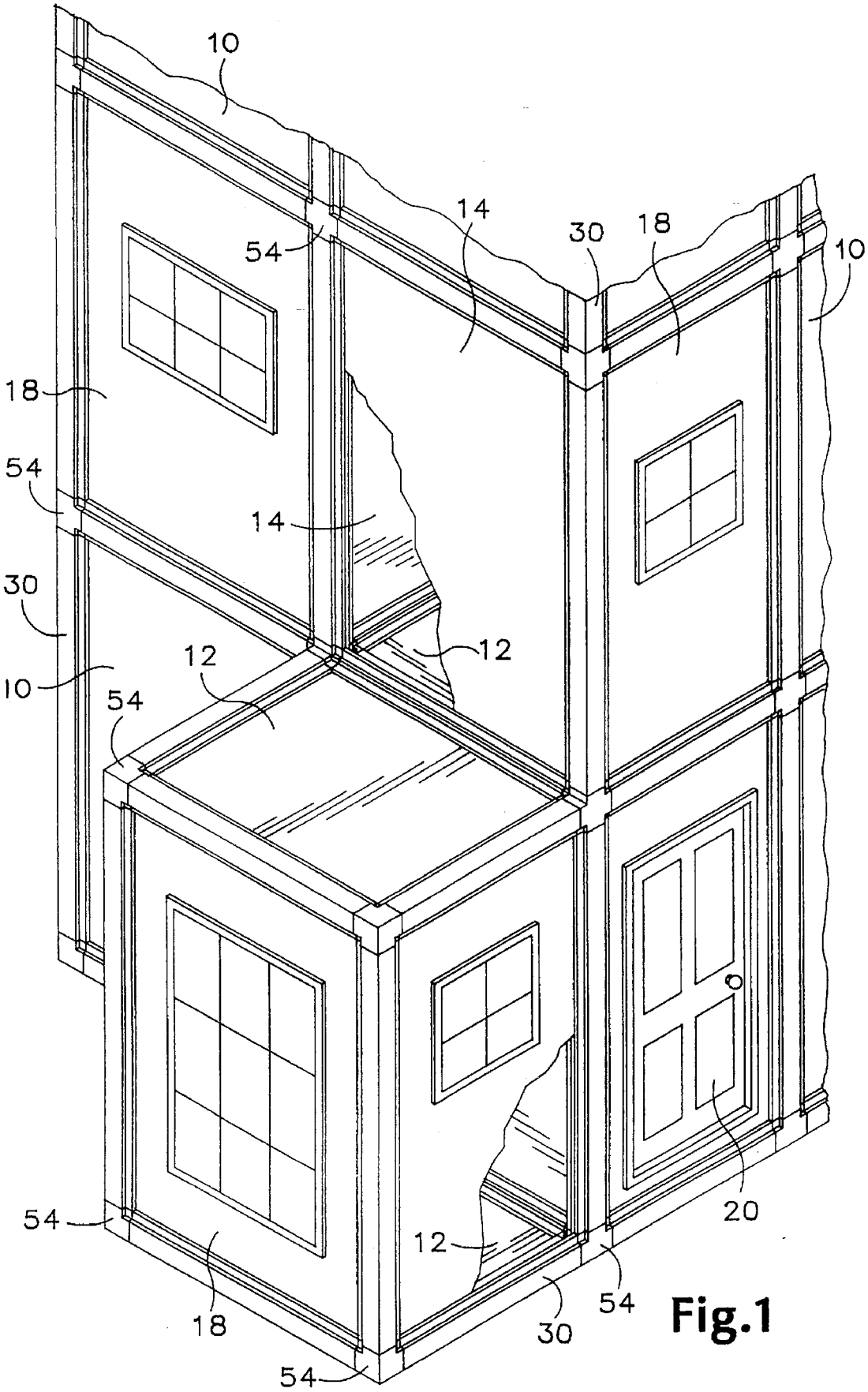
FIG. 1 is a fragmentary perspective view of the lower portions of a multi-level doll house formed by the panel connector system of this invention.
Figure 2:
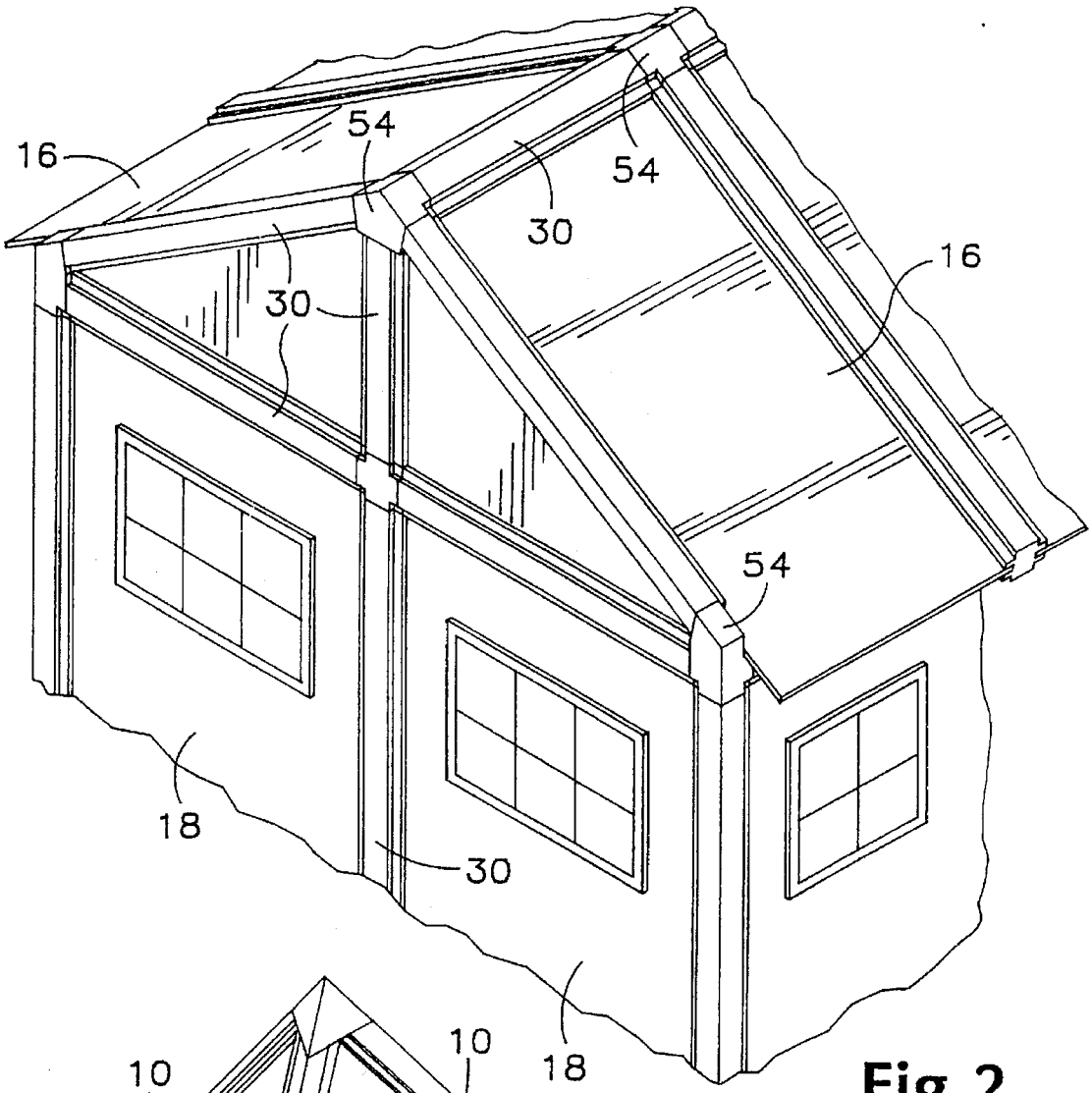
FIG. 2 is a fragmentary perspective view showing part of the upper portion of the doll house in FIG. 1.
Figure 3:
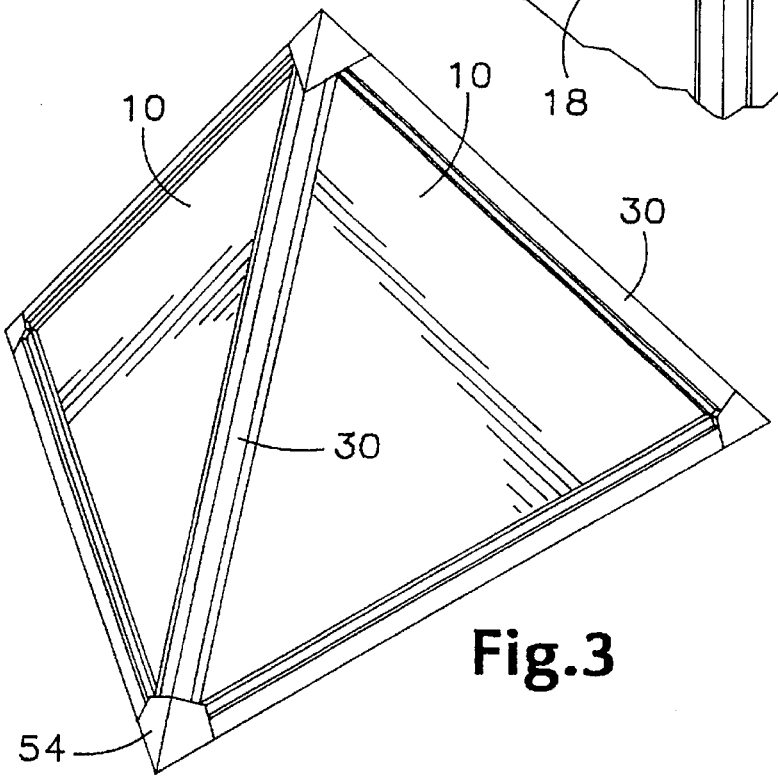
FIG. 3 is a perspective view of a pyramid structure formed by the construction system of this invention.

FIGS. 1 and 2 illustrate portions of an assembled doll house utilizing the panel construction system of this invention. FIG. 3 illustrates an example of other creative constructions that can be assembled with the construction system of this invention. As shown in FIGS. 1 and 2, the panels, designated generally at 10, used in such toy buildings may be provided as both solid panels, for floors 12, plain walls 14, roof panels 16, etc., and as specialty panels in the form of window wall panels 18, door wall panels 20, stairwell panels (not shown), and others as may be desired. In any case however, the panels 10 used in this construction system are formed of rigid sheet material such as plastic, plywood, metal and the like, and include a first component (indicated generally at 22) of the friction lock, snap-fit panel connector of this system, as will be described.

Figure 4:
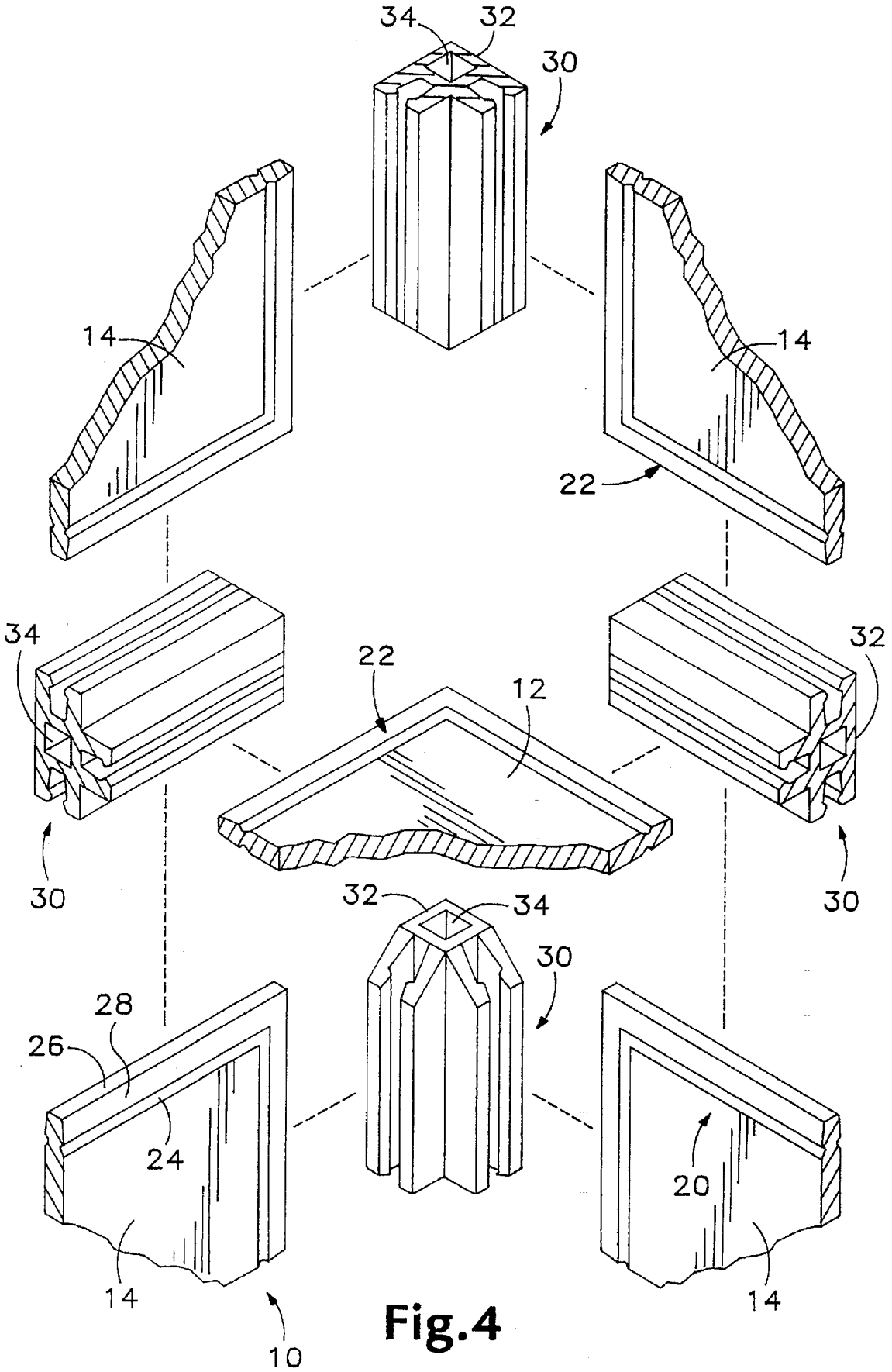
FIG. 4 is a fragmentary, exploded, perspective view of the panels and panel connector members embodying the features of this invention shown prior to assembly.
Figure 5:
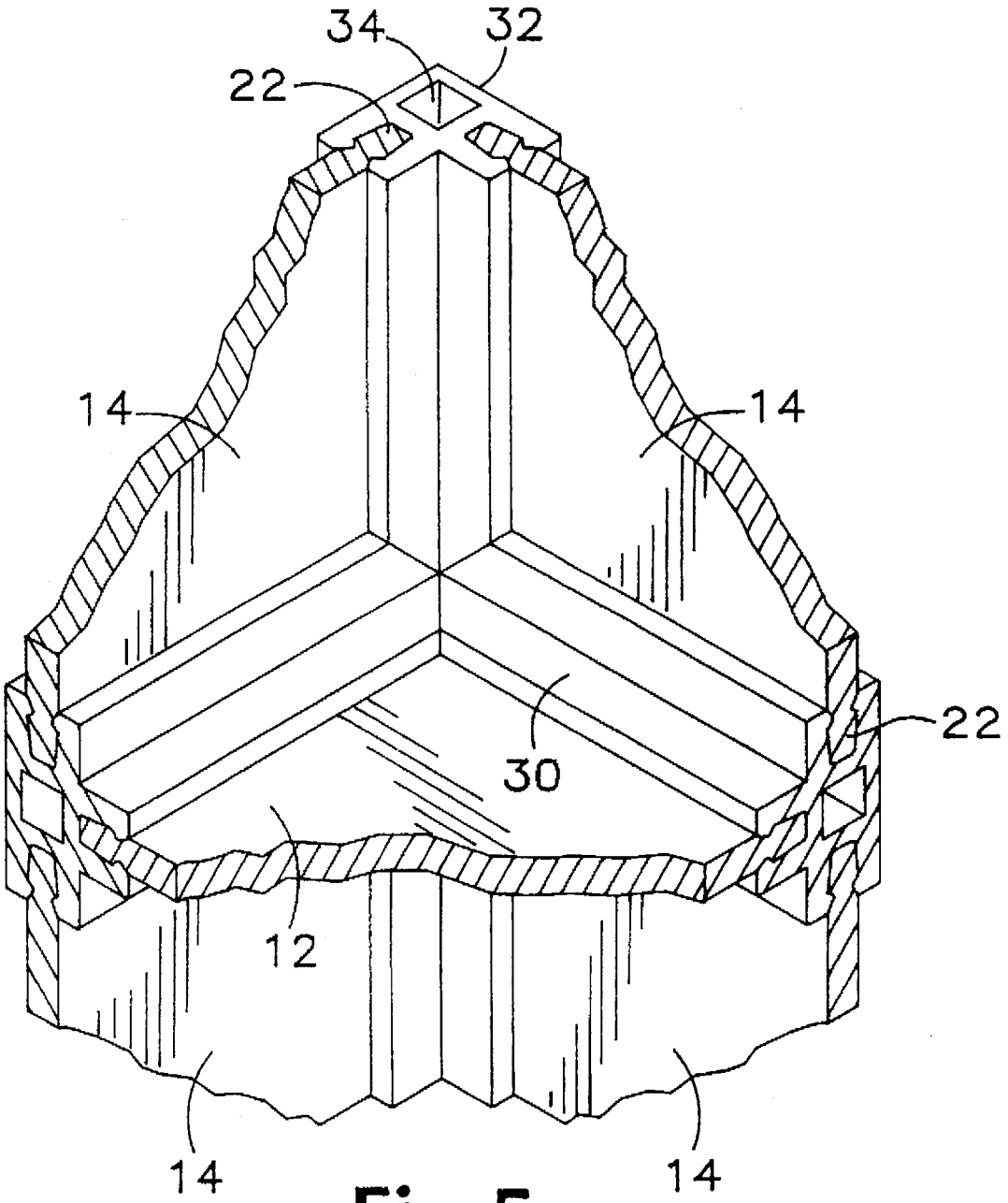
FIG. 5 is a fragmentary perspective view of the parts of FIG. 4 shown in assembled form.
Figure 6A:
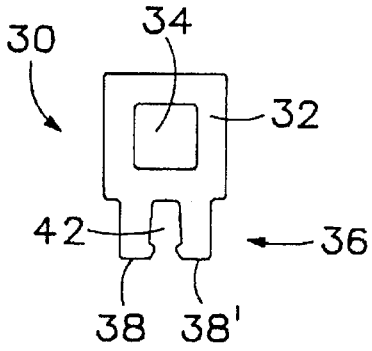
FIGS. 6*a*–6*f* are plan views illustrating various panel connector member configurations that may be provided in order to secure panels together in various different combinations and angular relationships relative to each other.
Figure 6B:
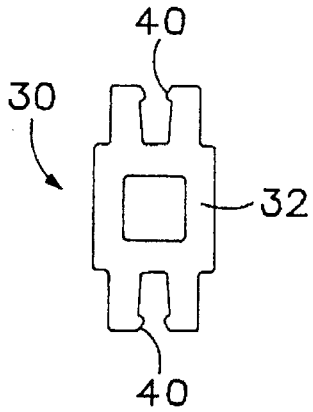
Figure 6C:
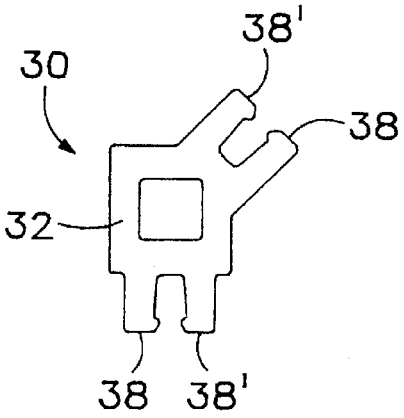
Figure 6D:
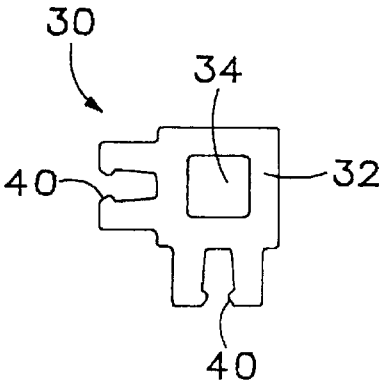
Figure 6E:
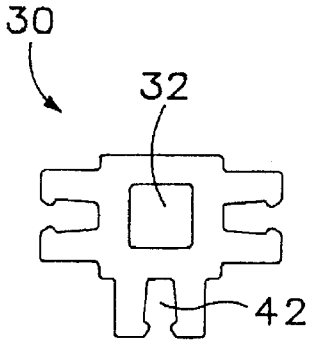
Figure 6F:
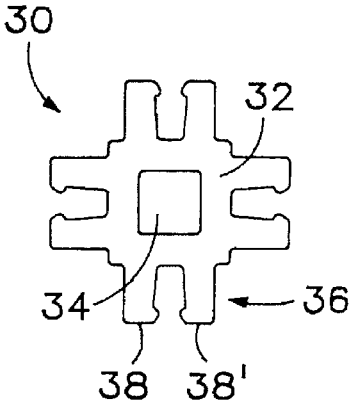
Figure 7A:
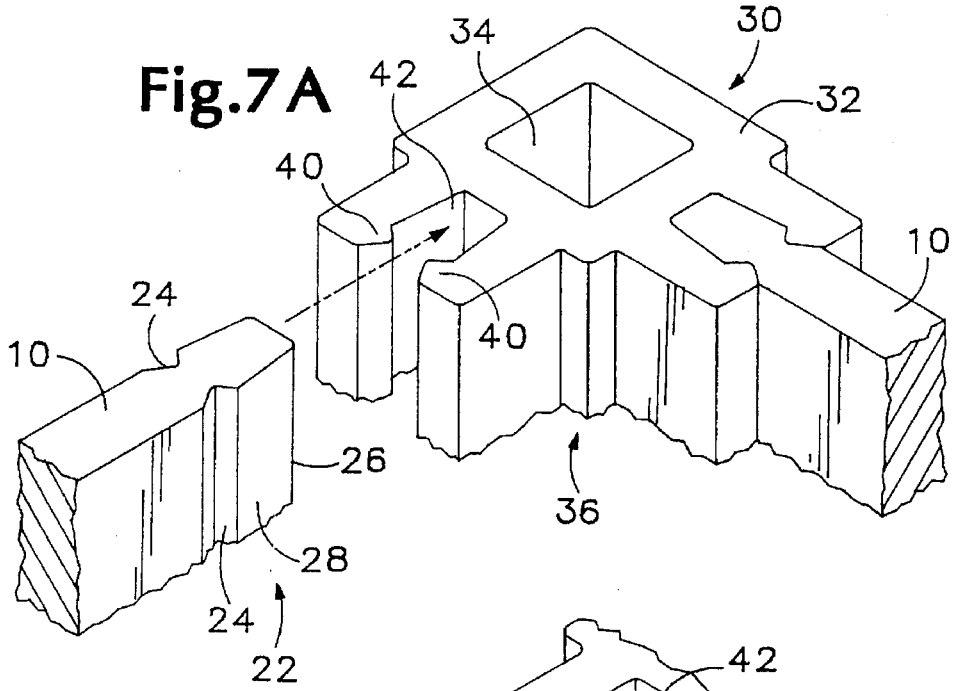
FIGS. 7*a*–7*c* are is a fragmentary perspective views illustrating various panel tongue configurations and their corresponding, mating locking members on the panel connector members.
Figure 7B:
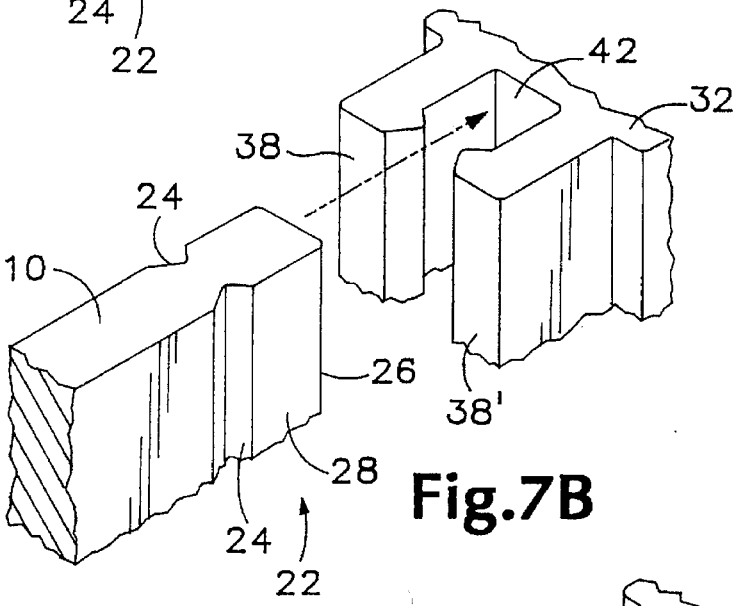
Figure 7C:
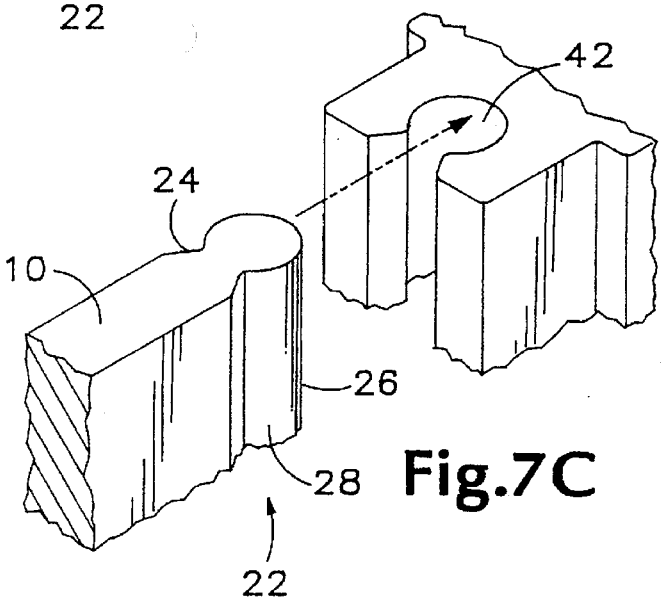

FIGS. 4 and 5 illustrate unassembled and assembled views of the essential elements required by the panel construction system of this invention in its most basic, fundamental form. The views show the connection of wall panels 14 and an upstairs floor panel 12 together to form an outside corner of a doll house having upper and lower floor levels.

As illustrated, the confronting edges of each panel 10 to be connected together is provided with an edge configuration that includes an elongated locking groove 24 on at least one face of the panel spaced inwardly from and extending parallel to the outside terminal edge 26 of the panel. The outer peripheral edge portion of the panel thus defined between the grooves 24 and the outside terminal edges 26 thereby forms a connector tongue 28 which is also specifically configured as will be explained later. The combination 24, 26, 28 thus described forms the first lock component 22 of the panel connection system.

Elongated panel connector members, indicated generally at 30, provide the second, corresponding component of a friction lock, snap fit connector of this system. As seen in FIGS. 4 and 5, and best in the plan views of FIG. 6, the panel connector members comprise a longitudinally elongated base member 32 which is configured in the embodiments illustrated to be substantially square in cross section, and preferably includes a longitudinally extending, preferably non-circular hollow center portion 34 throughout its length, essentially making the base member 32 an elongated, square tube.

The base member 32 mounts outwardly projecting, coextensive, snap fit lock members, illustrated generally as 36, configured to receive and frictionally engage the grooves 24 of the connector tongue portion of a panel to secure the panel thereto in a positive snap fit attachment. As illustrated the snap fit lock members each comprise a pair of stiffly resilient, spaced apart, opposite arm members 38, 38' projecting outwardly from the base member, the arms configured at their outer terminal ends with at least one inwardly facing locking detent 40 configured to frictionally engage the locking groove 24 provided on one or, as illustrated herein, both faces of a panel 10. Additionally, and as seen best in FIGS. *7a–7c*, it is important that the space 42 defined between the opposite arm members 38, 38' inwardly of the detents 40 is configured to matingly correspond to the particular surface configuration of the connector tongue 28 of the panel. In this manner there is achieved a fully mating, frictional, capturing engagement of the entire surface area along the length of the groove 24 and the connector tongue 28 of a panel in addition to the positive snap-fit locking of the panel therein by the tensioned engagement of the locking detents 40 with the lock grooves 24 provided by the stiffly resilient arm members. Accordingly, with a panel 10 and a connector member 30 thus engaged, unintended relative pivotal, axial and separational movement therebetween is virtually eliminated, and results in an extremely rigid, strong joint.

With the snap fit lock member 36 thus described, it will be further understood from the examples shown in FIGS. *6a–6f* that various different panel connector members may be provided in order to join panels together in various combinations and angular orientations as may be needed to suit virtually any construction need. In this, there are illustrated a number of connector members 30 having projecting snap fit lock members 36 mounted in various angular orientations relative to each other about their respective bases 32. It will be appreciated that in this manner, as evidenced in FIGS. 1–5, with panels having connector tongues 28 on all of their peripheral edges, virtually any arrangement of inside and out wall, floor, ceiling and roof combinations can be accomplished. Moreover, once one floor, wall or roof panel has been rigidly joined along each of its edges to the corresponding edges of its adjacent floor, wall or roof panels, an extremely strong, virtually unitary structure is formed in which the rigidly-joined panels themselves provide the weight-bearing structural integrity of the self-supporting construction.

The assembly of panels is simple, straightforward and creative. Desired panel connectors 30 are selected and snap fitted onto the edges of a first panel after which additional panels are then snap fitted onto those connectors forming the desired orientation of panels extending from the edges of the first panel. Then desired panel connectors are selected and attached to the free edges of the newly attached panels so that, as the process is repeated, the desired floor plan of joined inside and outside walls, floors and ceiling/upper floor levels is created. Virtually any combination of large rooms, small rooms and floor levels can be devised, limited only by one's own imagination and the number of panels and connectors on hand.

In that regard, it is to be noted that an important aspect of the particular configuration of the panel connector members 30 is that, in all of their various configurations, they can be manufactured extremely economically as simple extrusions of a desired material such as plastic or metal, etc. Also, since any number of conventional and economical methods can be selected to produce the panels and provide them with the locking grooves 24 and connector tongue 28 configurations of this invention, it will be appreciated that the construction system of this invention, made available either in kit form or in individual parts, may be provided very economically to the marketplace.

The foregoing has illustrated the basic concept of this invention in relation to small scale constructions such as toy doll houses and the like for assembly primarily within the capabilities of children. In that regard, the panels 10 have thus far been described only in terms of incorporating the first component of the friction lock, snap fit connector of this invention as an integral part of their manufactured structure. While certainly both the panels 10 and corresponding panel connector members 30 could be provided in this manner for full size constructions such as utility and storage sheds, etc., the construction system of this invention also accommodates the use of non-specialized panels, such as standard plywood sheets and the like, for lower cost and even greater versatility in construction.

Figure 8:
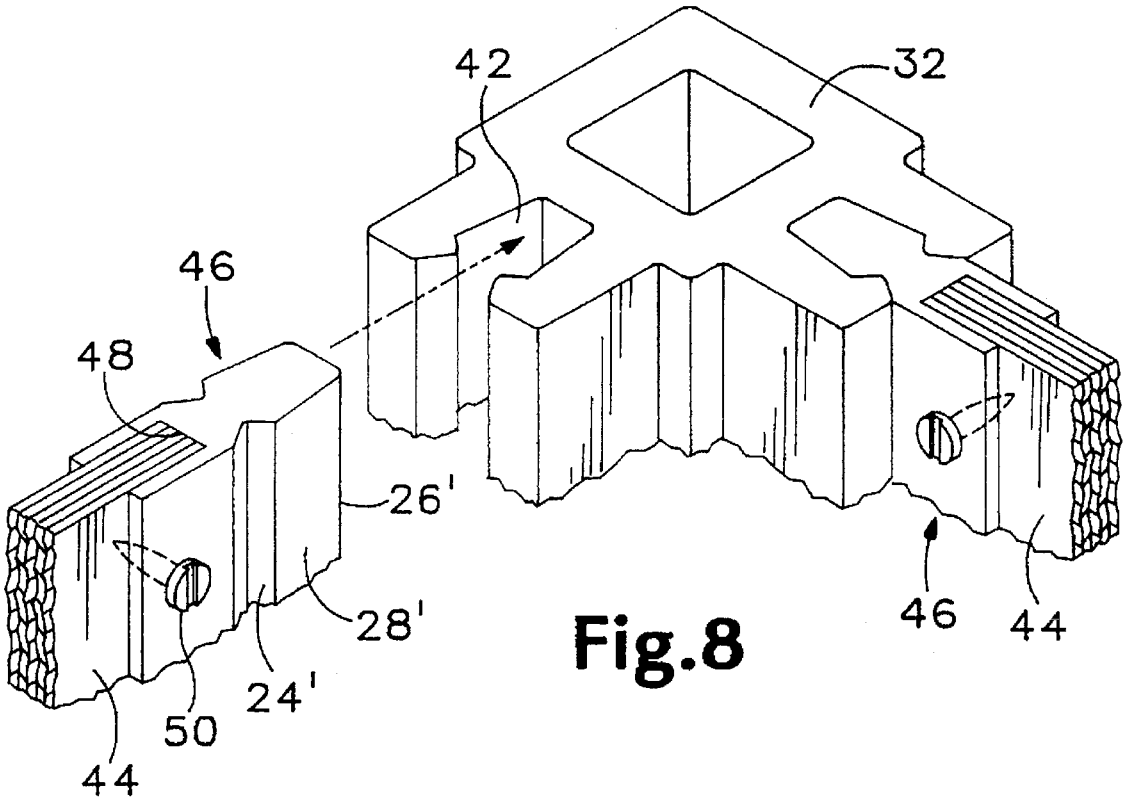
FIG. 8 is a fragmentary perspective view illustrating the panel connector system of this invention adapted to secure standard plywood sheets together.

In this connection, reference is made to FIG. 8 of the drawings wherein there is shown a portion of a standard plywood panel 44 mounting the first locking component of the friction lock, snap fit connector system of this invention now provided in the form of an attachable locking edge member 46. As is evidenced, the locking edge members are provided as elongated strips for attachment to the edges of a panel, and include mounting means, U-shaped mounting channel 48 in this embodiment, by which they can be easily attached to a panel. Any suitable means may be used to secure the locking edge member and the panel together, such as by bonding, bolts or screws 50, welding if appropriate, or other conventional method as may be desired.

As illustrated, the portion of the locking edge member extending from the mounting channel 48 provides the first locking component 22 of the snap fit panel connector of this invention, and is configured to provide the locking groove 24'. the outside terminal edge 26' and outer peripheral edge portion 28' which are configured to matingly correspond in snap fit connection with the second locking component 36 on the panel connector members 30, as have been described before in connection with the earlier embodiment of the invention. This arrangement, aside from permitting the use of standard plywood panels, further allows the user to cut the panels to desired dimensions for a particular construction need prior to installing the locking edge members 46 which also may be cut to size as can the panel connector members 30.

It will be further apparent to those skilled in the art that both of the panel connector elements 30, 46 in this embodiment of the invention may be produced as extrusions of suitable materials and thus may provide a very economical and simplified manufacture of the construction system of this invention.

Figure 9:
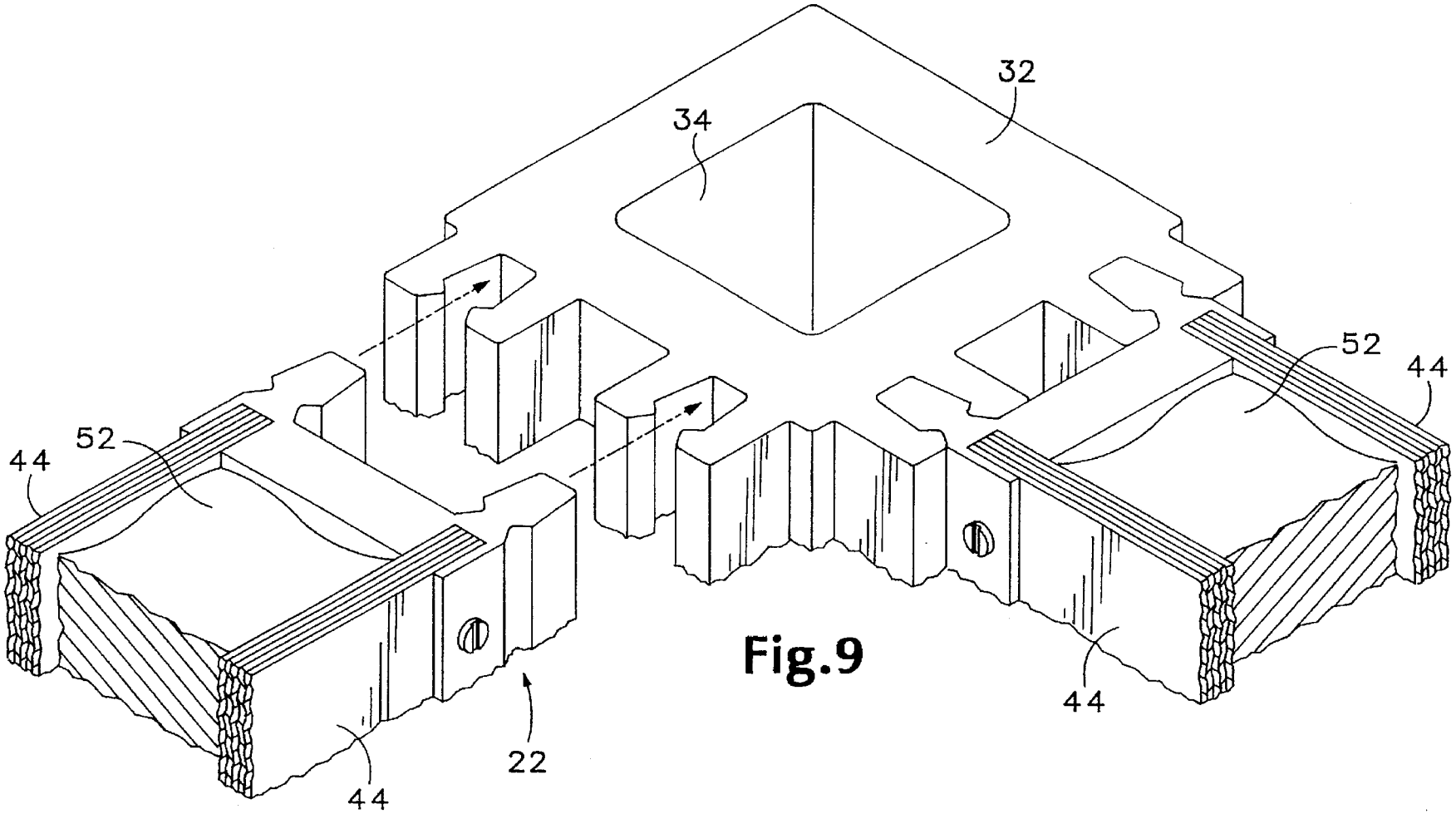
FIG. 9 is a fragmentary perspective view of the panel connector arrangement of FIG. 8 further adapted to provide for a double-wall construction of assembled panels.

FIG. 9 illustrates the basic panel connector arrangement of FIG. 8 further modified to show one embodiment of a connector system configured to provide a double wall construction for the assembly of structures which may include insulation 52 between the inside and outside panels of the walls, floors, etc.

Figure 10:
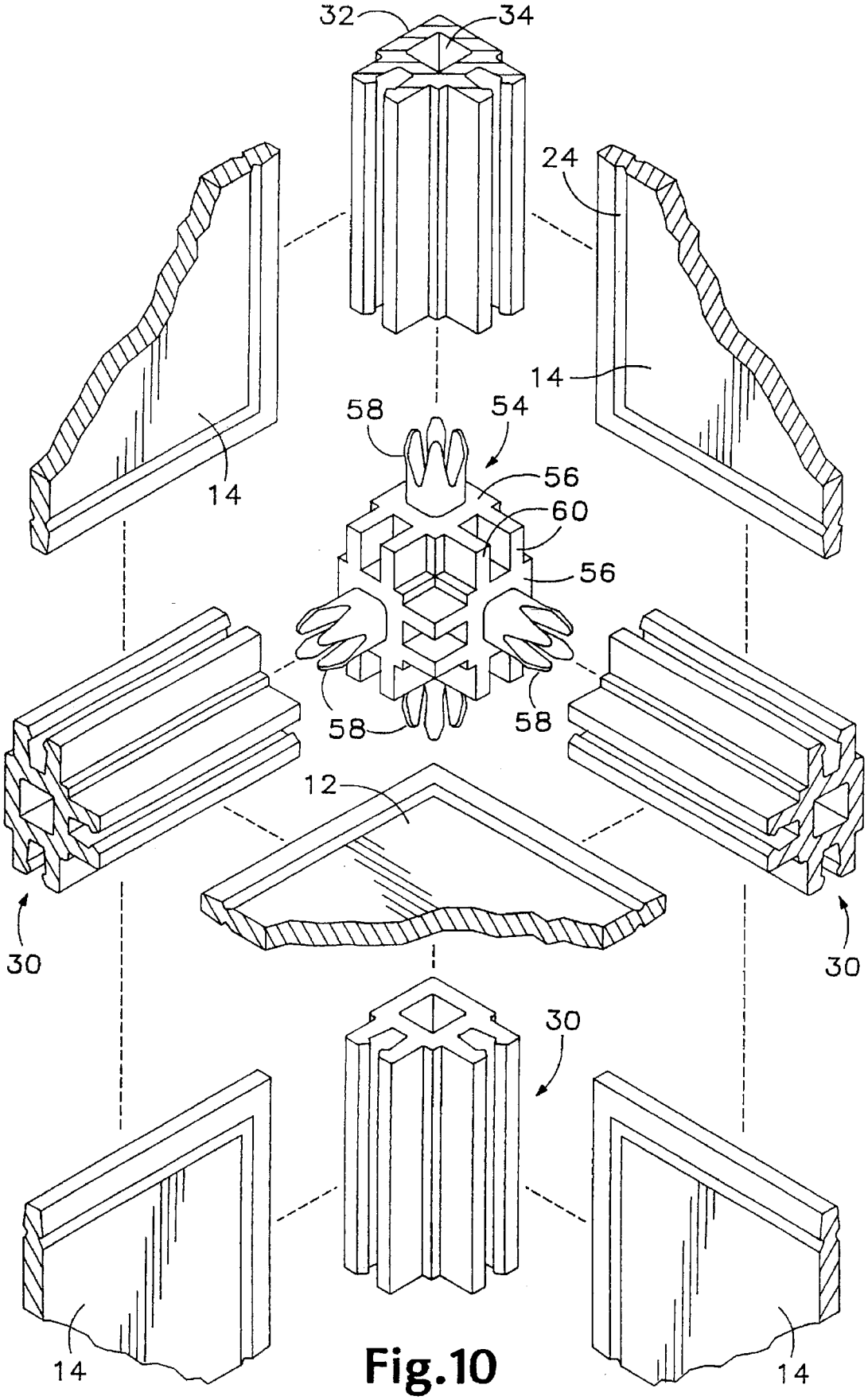
FIG. 10 is a fragmentary, exploded perspective view of the basic panel connector system parts of this invention, similar to those shown in FIG. 4, but including a preferred embodiment of a panel connector member junction block configured to frictionally secure adjacent panel connector members directly together for the purpose of providing a joint having a finished appearance.
Figure 11:
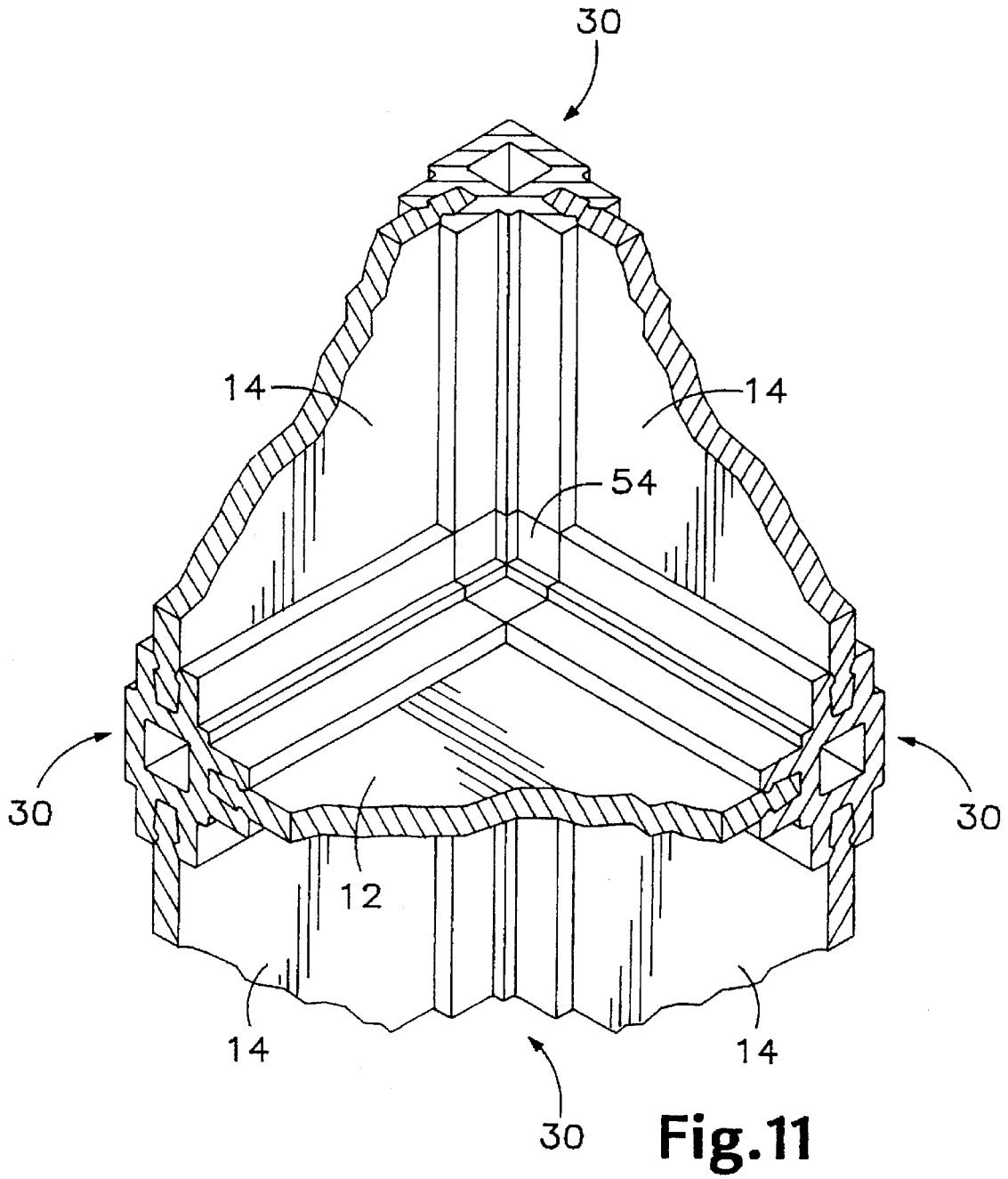
FIG. 11 is a fragmentary perspective view of the parts of FIG. 10 in assembled condition.
Figure 12:
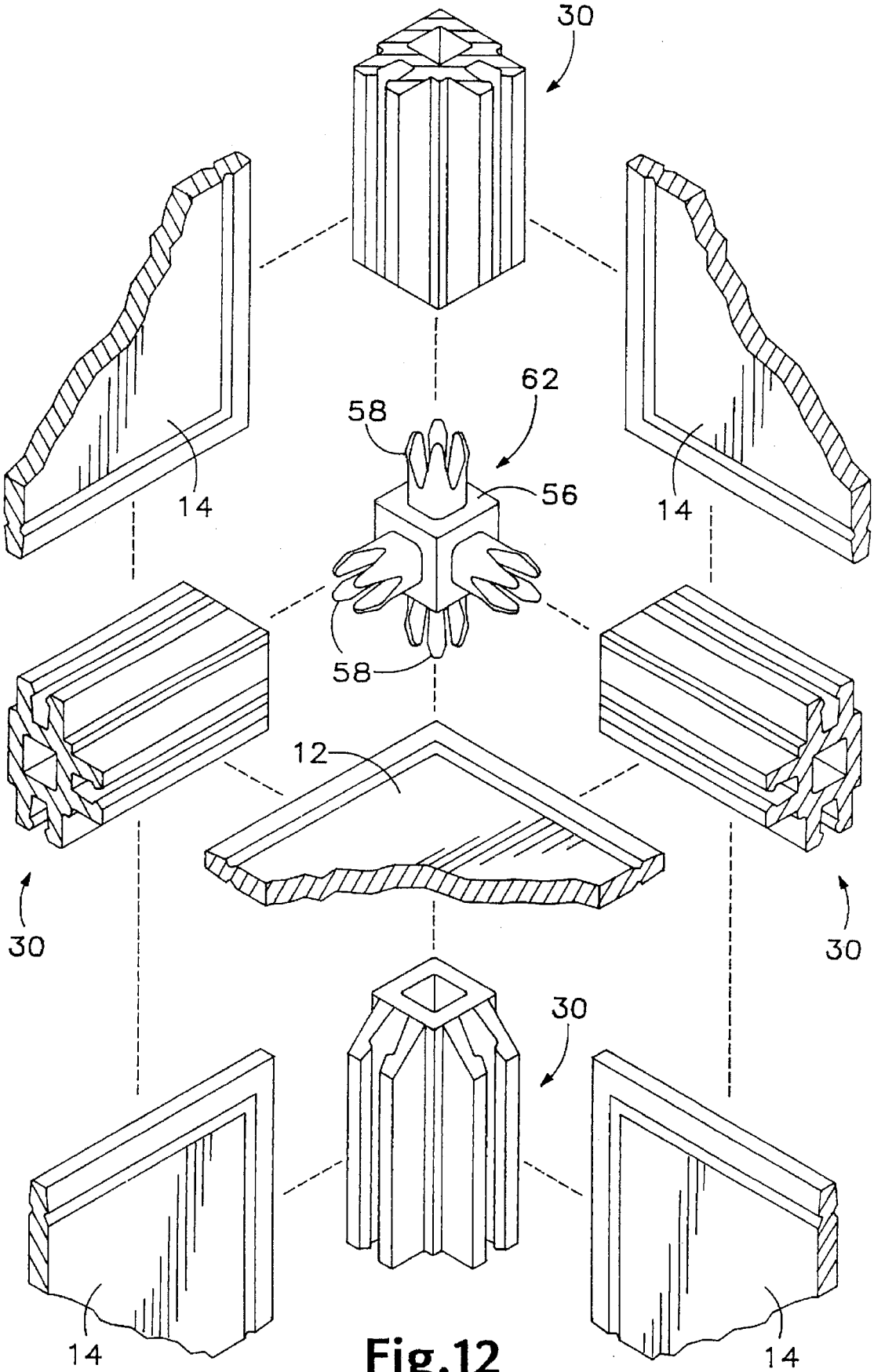
FIGS. 12, 13, and 14, 15 are fragmentary perspective views similar to FIGS. 10 and 11 illustrating respective views of two alternative junction block configurations.
Figure 13:
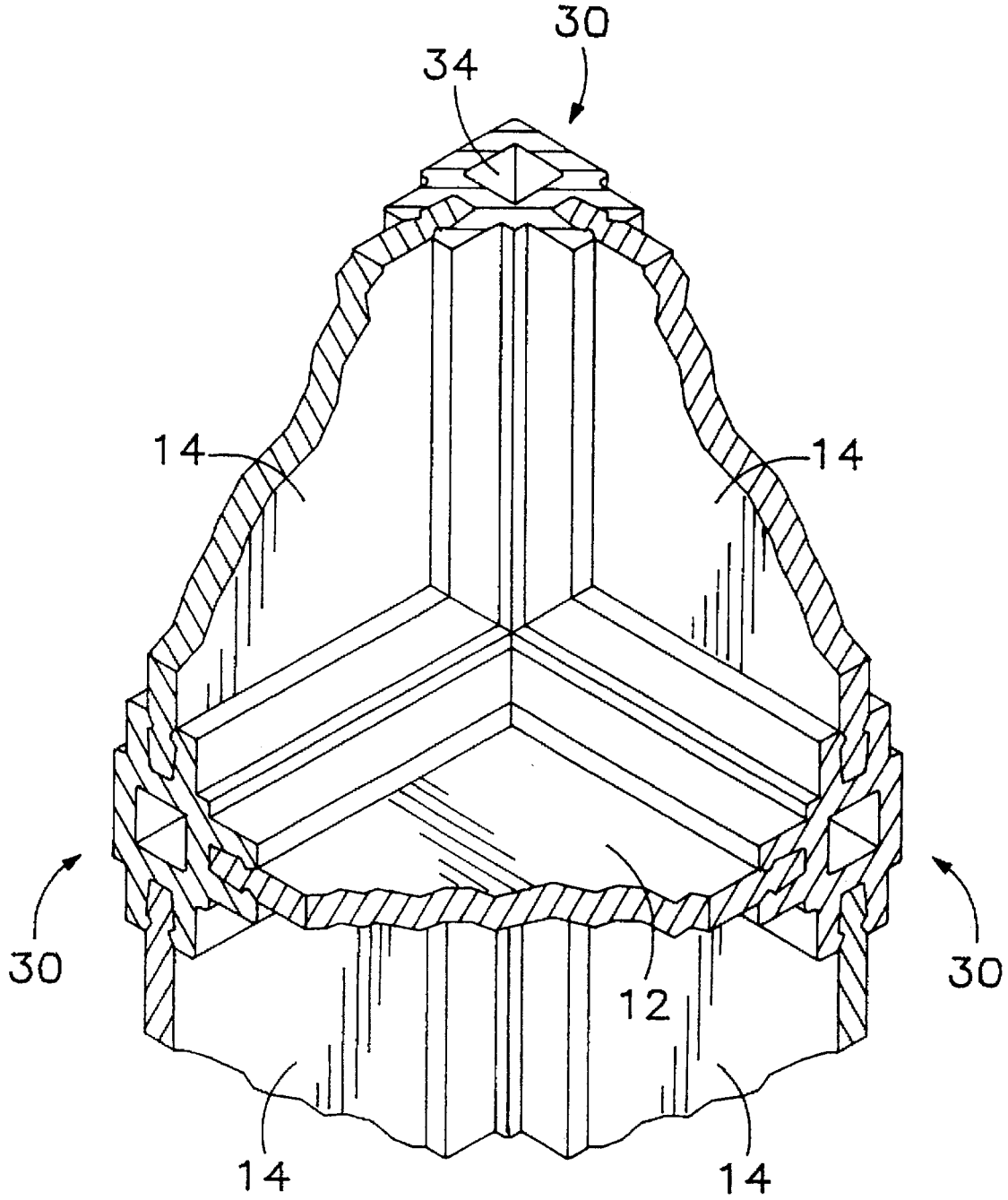
Figure 14:
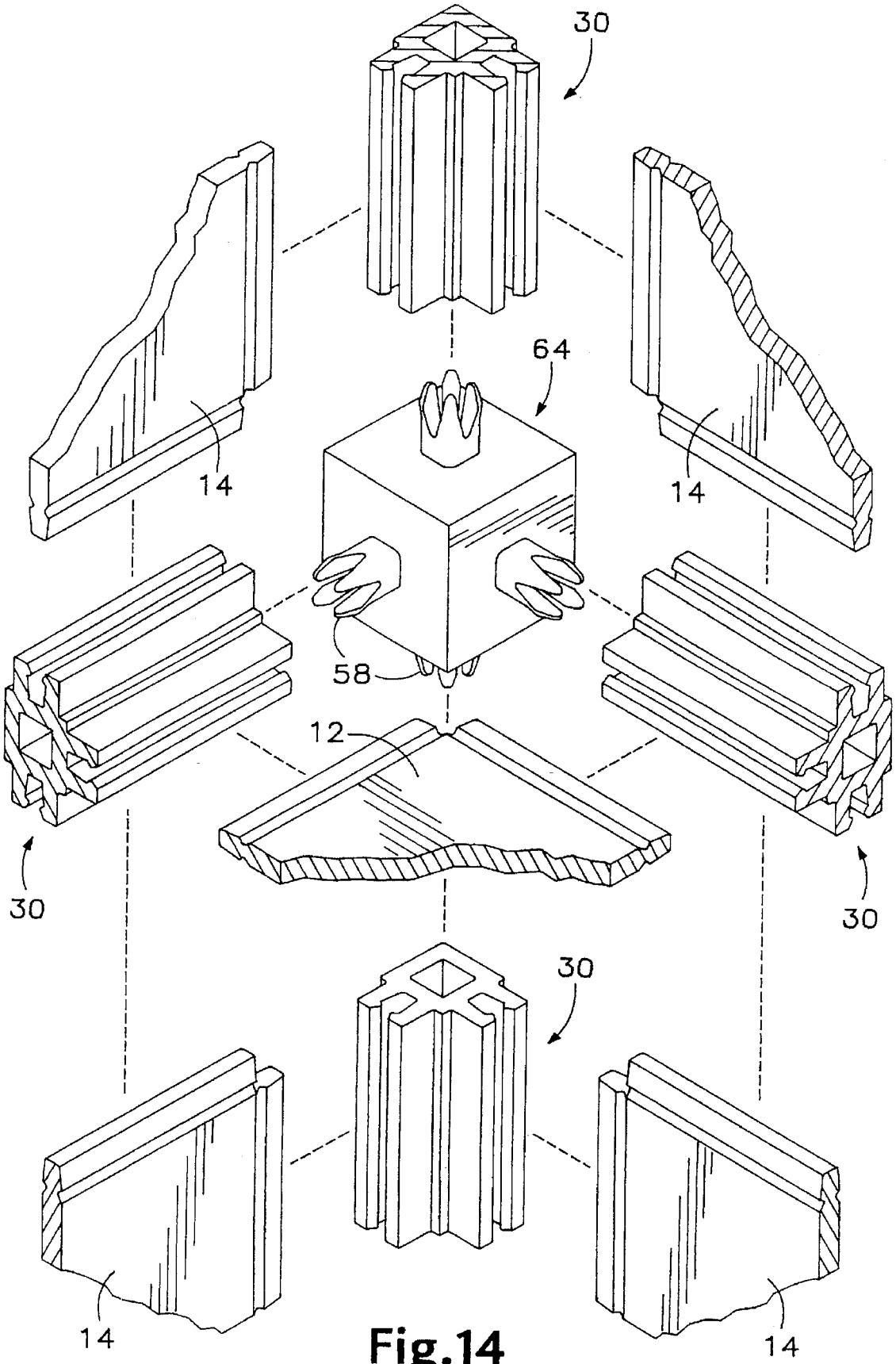
Figure 15:
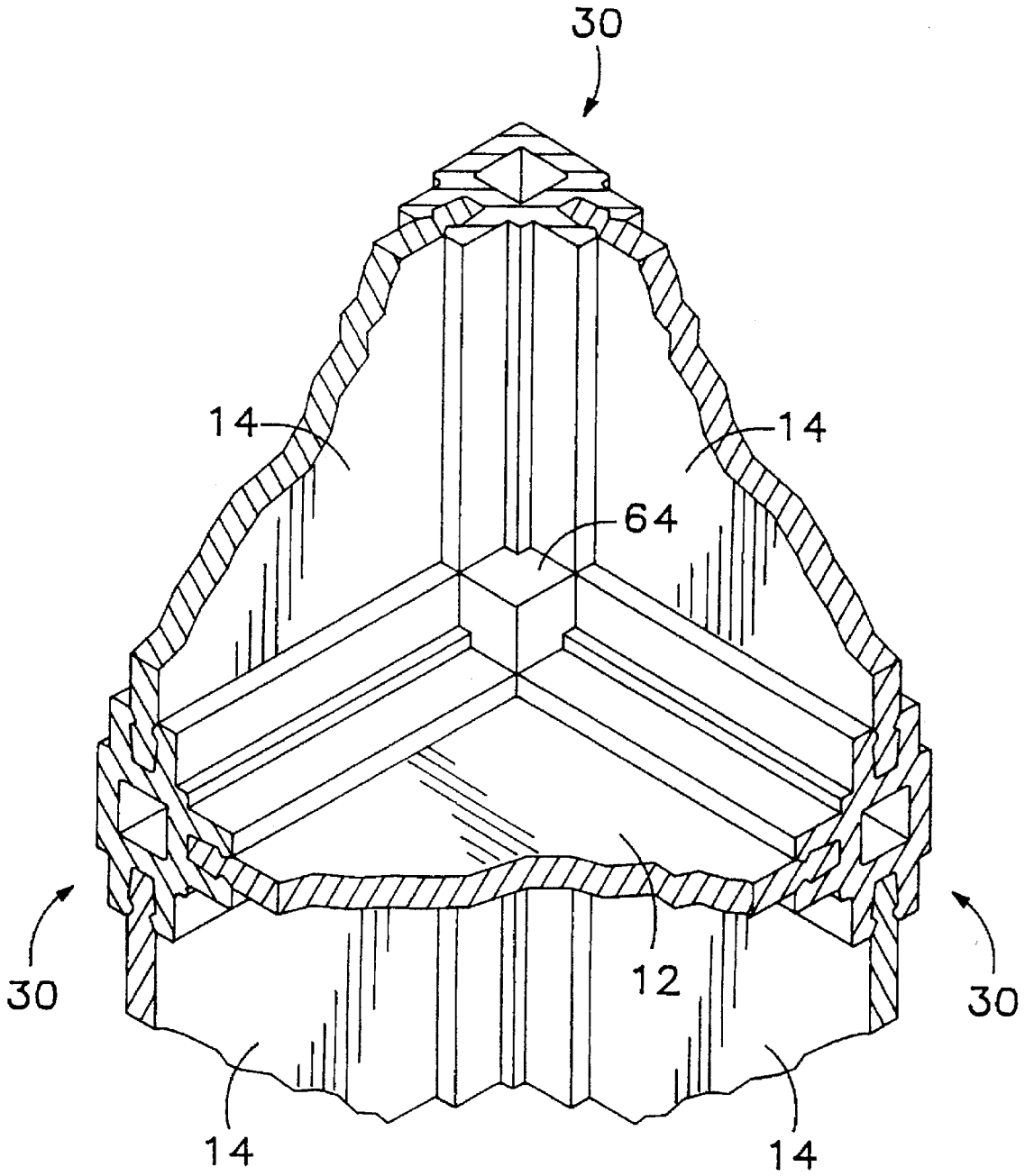
Figure 16A:
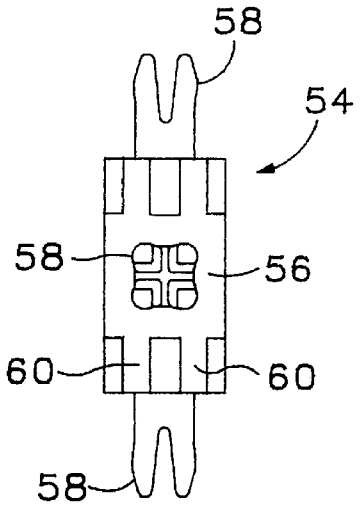
FIGS. 16*a*–16*e* are plan views of different configurations of the preferred embodiment of the junction block illustrated in FIGS. 10 and 11.
Figure 16B:
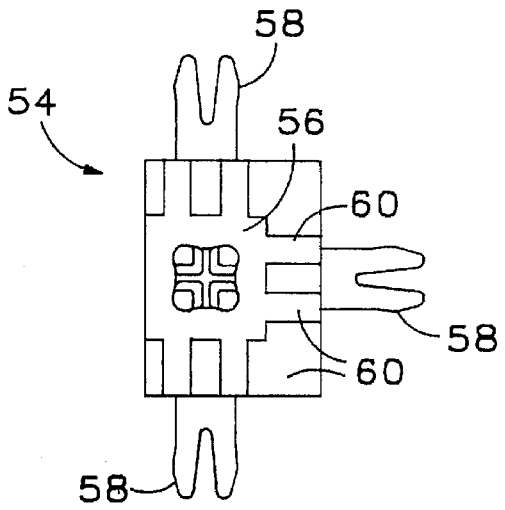
Figure 16C:
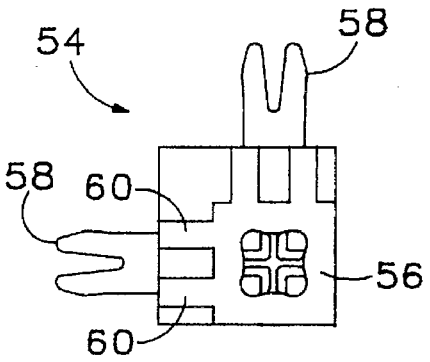
Figure 16D:
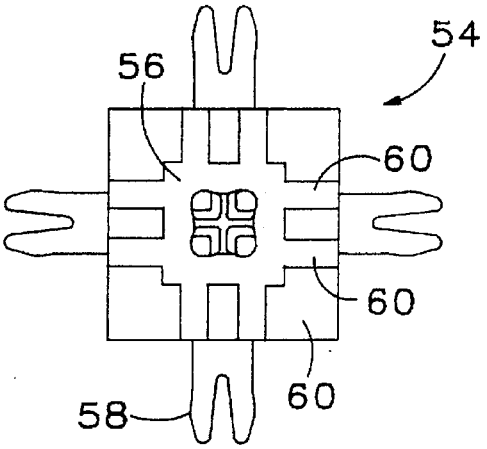
Figure 16E:
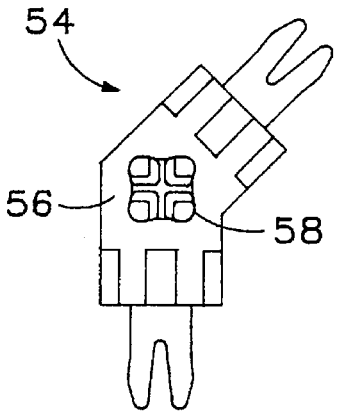

FIGS. 10 and 11, 12 and 13, and 14 and 15 illustrate respective unassembled and assembled views (similar to FIGS. 4 and 5) of the previously-described basic construction system of this invention further including three different embodiments of a junction block configured to secure adjoining panel connector members 30 directly to each other and eliminate the need to taper the ends of the members 30 as seen in FIGS. 4 and 5 in order to provide a "finished appearance" at the junction of the assembled panels and connectors. FIGS. 10 and 11 illustrate the preferred embodiment 54 of a junction block which is a molded piece provided with a base 56 having the same dimensions as the base 32 of the panel connector members 30. Means for securing the junction block and the panel connector members together is provided, and in the embodiments illustrated is accomplished by the provision of preferably non-circular studs 58 on the bases 56, the studs configured to be received by and engaged in the center portion 34 of the connector members 30 in a frictional, press-in fit. Spaced apart wall members 60 are configured to align with the arm members 38, 38' of the connector members and are provided to receive therebetween and enclosed from view the corner portion of a panel engaged by the arms.

As shown in the plan views of FIGS. 16*a*–16*e*, a variety of different configurations of the junction blocks 54 are provided to correspond to the various configurations of panel connector members that are to be coupled together and the various angular relationships that the assembled panels are disposed relative to each other when assembled. The junction blocks 62, 64 shown in FIGS. 12–15 simply illustrate alternatives to the preferred embodiment.

From the foregoing it will be apparent to those skilled in the art that the panel connector method and system of this invention provides a greatly improved and simplified way of rigidly and positively securing rigid sheet-like panels together in order to assemble, strong, self-supporting constructions in which the assembled panels, by virtue of their inflexible, locked connection to each other, provide the weight bearing structural integrity of the resulting construction. It will also be apparent from the foregoing, that, in addition to those already discussed, many other changes may be made in the size, shape, type, number and arrangement of parts described hereinbefore without departing from the spirit of this invention and the scope of the appended claims.

Having thus described my invention and the manner in which it may be used, I claim:

1. A panel connector system for connecting a plurality of panels together in positive, snap fit, locking engagement in desired angular relationship relative to each other for the construction of various structurally rigid structures in which the connected panels themselves provide the weight-bearing structural integrity and strength of the resulting structure, the panel connector system comprising:

a) a first connector component associated with each of at least two peripheral edges of each of a plurality of panels to be connected together, each said first connector component defined by a longitudinally extending confronting panel edge and an associated locking groove in at least one face of the panel spaced inwardly of and extending parallel to said confronting panel edge and defining therebetween a connector tongue having a specific, predetermined surface configuration, and b) a second connector component configured to receive and engage at least two of said first connector components in locking, snap-fit engagement, said second connector component comprising a plurality of elongated panel connector members each having a longitudinally elongated base configured with a common, uniform cross section, at least two pairs of locking members coextensive with and extending from said base at different angles, each locking member comprising a pair of arms spaced apart and defining a space therebetween configured to correspondingly receive a connector tongue of a panel, a locking detent on at least one of said pair of arms projecting toward the other arm of said pair, the locking detent being configured to engage the corresponding locking groove in an associated panel in a snap fit connection, the pair of arms and the space defined therebetween configured to matingly correspond to the specific surface configuration of a connector tongue to be received therebetween in a rigid, full contact, locked engagement in which relative movement between the first and second connector components is prevented, c) whereby panels thus connected together are retained against movement relative to each other and thus form a rigid, essentially unitary member in which the joined panels provide the weight bearing structural strength and integrity of an assembled structure.

2. The connector system of claim 1 wherein said first connector component is provided as an elongated strip member arranged for mounting along an edge of a panel, the elongated strip having a base member arranged to engage and be secured to a panel along an edge thereof, the base member mounting a projecting portion configured to provide the confronting edge, locking groove, and connector tongue of the first connector component.

3. The connector system of claim 2 wherein said first and second connector components are formed as extrusions of desired extrudable material.

4. The connector system of claim 1 including junction block members configured to engage the longitudinal ends of at least two panel connector members and frictionally secure them together for extension of the panel connector members therefrom in desired angular relationship relative to each other.

5. The connector system of claim 4 wherein each said junction block includes at least two base members disposed in desired angular relationship relative to each other, said base members having the same cross sectional configuration as the bases of the elongated panel connector members and each base member mounting one component of a press-fit connector, the longitudinal terminal ends of the panel connector members mounting the second, corresponding component of a press fit connector whereby panel connector members may be frictionally secured to the junction block for extension of the panel connector members from the junction block along a line that is defined by and perpendicular to the plane of the corresponding base members of the junction block.

6. A method for connecting a plurality of rigid panels together to form desired structures, the method comprising providing at least two peripheral edges of each panel to be connected together with a longitudinally extending, confronting panel edge and a locking groove in at least one face of the panel spaced inwardly of and extending parallel to said confronting panel edge and forming therebetween a longitudinally extending connector tongue having a specific, predetermined surface configuration, and engaging said confronting edge, locking groove and connector tongue of at least two panels in a mating, fully contacting, locking, snap-fit frictional engagement within corresponding longitudinally extending locking members projecting outwardly from a longitudinally elongated panel connector member in desired, predetermined angular relationship, whereby panels thus engaged are securely retained against relative movement in frictional, mating, snap-fit connection along their confronting edges for extension of the joined panels therefrom at desired angles relative to each other.

7. The method of claim 6 wherein all of the peripheral edges of at least one of a plurality of panels are provided said confronting edge and locking groove and connector tongue, and a panel connector member is provided on each peripheral edge of said one panel, each panel connector member receiving and engaging at least one of the plurality of panels in a desired angular disposition relative to said one panel, whereby one or more panels engage and extend in desired directions from each peripheral edge of at least one of a plurality of panels.

* * * * *